United States Patent [19]

Hardt

[11] Patent Number: 4,716,836

[45] Date of Patent: Jan. 5, 1988

[54] SUSPENDED RAIL WELDER

[75] Inventor: Robert C. Hardt, Country Club Hills, Ill.

[73] Assignee: H. A. Schlatter AG, Switzerland

[21] Appl. No.: 885,270

[22] Filed: Jul. 14, 1986

[51] Int. Cl.[4] ..... E01B 11/44

[52] U.S. Cl. ..... 104/15; 269/43; 269/46

[58] Field of Search ..... 104/15; 269/43, 46

[56] References Cited

U.S. PATENT DOCUMENTS

| | | | |
|---|---|---|---|
| 3,635,165 | 1/1972 | Platov et al. | 104/15 |
| 3,802,348 | 4/1974 | Bryan, Jr. | 104/15 |
| 4,320,708 | 3/1982 | Bommart | 104/15 X |
| 4,641,818 | 2/1987 | Bommart | 269/43 |
| 4,674,730 | 6/1987 | Roberts | 269/43 |

FOREIGN PATENT DOCUMENTS

| | | | |
|---|---|---|---|
| 1235164 | 6/1971 | United Kingdom | 104/15 |
| 172415 | 6/1965 | U.S.S.R. | 269/43 |

*Primary Examiner*—Peter A. Aschenbrenner
*Assistant Examiner*—Laurie K. Cranmer
*Attorney, Agent, or Firm*—Robert E. Knechtel; Basil E. Demeur

[57] ABSTRACT

A suspended rail welder which includes, generally, two clamping units which are supported by a beam which is affixed to a boom for raising and lowering the rail welder to the rails which are to be welded together. The two clamping units are coupled to one another by a pair of upset tube assemblies which extend between and through both clamping units. Each of these upset tube assemblies is formed of a hollow rectangular tube which supports within them a straight edge which is used to geometrically align both horizontally and vertically the rails to be welded together.

10 Claims, 15 Drawing Figures

| FIG. 7 | FIG. 6 |
|---|---|

SUSPENDED RAIL WELDER

This invention relates to an improved rail welder for welding railroad rails together end-to-end to form a continuous rail.

More particularly, the rail welder of the present invention is of the suspended type, i.e., one which is supported by a boom and raised and lowered with respect to the rails, as opposed to those rail welders wherein the rails are effectively raised and fed into the rail welder. Such suspended rail welders in the past have not given the operator geometric aligning control of the top and sides of dissimilar rail heads without outside assistance from other machines or by people. Also, there has not been a successful mechanical way to measure the alignment of these surfaces because the welder elements have blocked the access of instruments for measurements and the sight of the people who would take the readings. Further still, these rail welders have not contained or used systems to move the rails forcefully inside the welder. In most cases, spring pushers are used which force the top surface against reference blocks and pre-positioned electrodes which only force the rail web to a preposition without provision for adjustment or re-position when required. In view of these, as well as other undesirable features not specifically mentioned, most if not all of the prior suspended rail welders are considered to be less than acceptable since they fail to provide consistently acceptable alignment and geometric tolerances in the welds.

The above as well as other objectionable features of prior suspended rail welders are overcome by the improved suspended rail welder of the present invention which includes, generally, two clamping units which are supported by a beam which is affixed to a boom for raising and lowering the rail welder to the rails which are to be welded together. The two clamping units are coupled to one another by a pair of upset tube assemblies which extend between and through both clamping units.

Each of these upset tube assemblies is formed of a hollow rectangular tube which supports within them a straight edge which is used to geometrically align both horizontally and vertically the rails to be welded together. These hollow rectangular tubes support the straight edges such that there are no bending forces exerted upon them, and further shelter the straight edges from mechanical damage and the process heat and dirt. The hollow rectangular tubes also function as the upset rods for axially reciprocally displacing the clamping units with respect to one another during the welding operation. The use of these hollow rectangular tubes as the upset rods, as opposed to cylindrical upset rods as is normally used, provides the distinct advantage of being able to use flat, tapered wedges which can be repeatedly adjusted before replacement of the wedges is required with the cylindrical upset rods' round bushings, which normally cannot be adjusted after initial installation are used.

The geometry sensing system is comprised of two or more push rods which are disposed in one of the two clamping units and which are spring-loaded to abut against one of the two rails to be welded together. These push rods extend through one of the hollow rectangular tubes forming one of the upset tube assemblies, and through the straight edge contained therein. The push rods are adjustably affixed to the straight edge. Since these two push rods abut against the same rail and are affixed to the straight edge, the straight edge is positioned parallel to that rail.

As stated, the straight edge extends through the hollow rectangular tube, and its other end is disposed within the other one of the two clamping units. This other one of the two clamping units includes two push rods which are affixed to the straight edge and extend outwardly through the hollow rectangular tube. These push rods are of the same length and have a vertical reference plate affixed to the ends thereof. Since the straight edge is positioned parallel to the rail clamped in the one clamping unit, and the vertical reference plate is parallel to the straight edge, the vertical reference plate also is parallel to the rail.

This other one of the two clamping units also includes two push rods which are pressed against the rail clamped therein, and the ends of these two push rods are connected to a table which extends across the hollow rectangular tube in the clamping unit and is slidably supported by the latter. This table supports two proximity or sensor switches in a position to be engaged by the vertical reference plate.

The arrangement is such that the two proximity or sensor switches are activated when the rails clamped in the respective clamping units are out of alignment in one direction. In the other direction, the proximity or sensor switches are not activated. The rail welder's logic system detects the activated/unactivated condition of the proximity switches to signal actuators to correct the sensed error.

An identical system associated with the other upset tube assembly allows the operator to select the system and rail head side to be aligned.

A nearly identical system senses the vertical alignment of the two rails to be welded together. In this case, however, the push rods have deflected spring assemblies attached to the ends thereof which engage the top of the rail heads. The deflecting spring assemblies emulate bell cranks and translate the vertical position of the rails to horizontal displacement of the push rods.

The larger outside surfaces of the hollow rectangular tubes which function as the upset rods also allows large flat surface bearings to be used to absorb the forces of rail manipulation. Such flat surface bearings are readily available and are nonmetallic. The surface bearings, therefore, also provide electric insulation between adjacent charged parts. The flat surface bearings furthermore can be adjusted for wear, whereas the round bushings normally used could not be adjusted for position and wear.

Accordingly, it is an object of the invention to provide an improved suspended rail welder for welding railroad rails together end-to-end to form a continuous rail.

BRIEF DESCRIPTION OF THE DRAWINGS

These as well as other objects and improved features of the rail welder will be apparent from the following description, when taken in consideration with the drawings, wherein.

DESCRIPTION OF A PREFERRED EMBODIMENT

Figure 1:
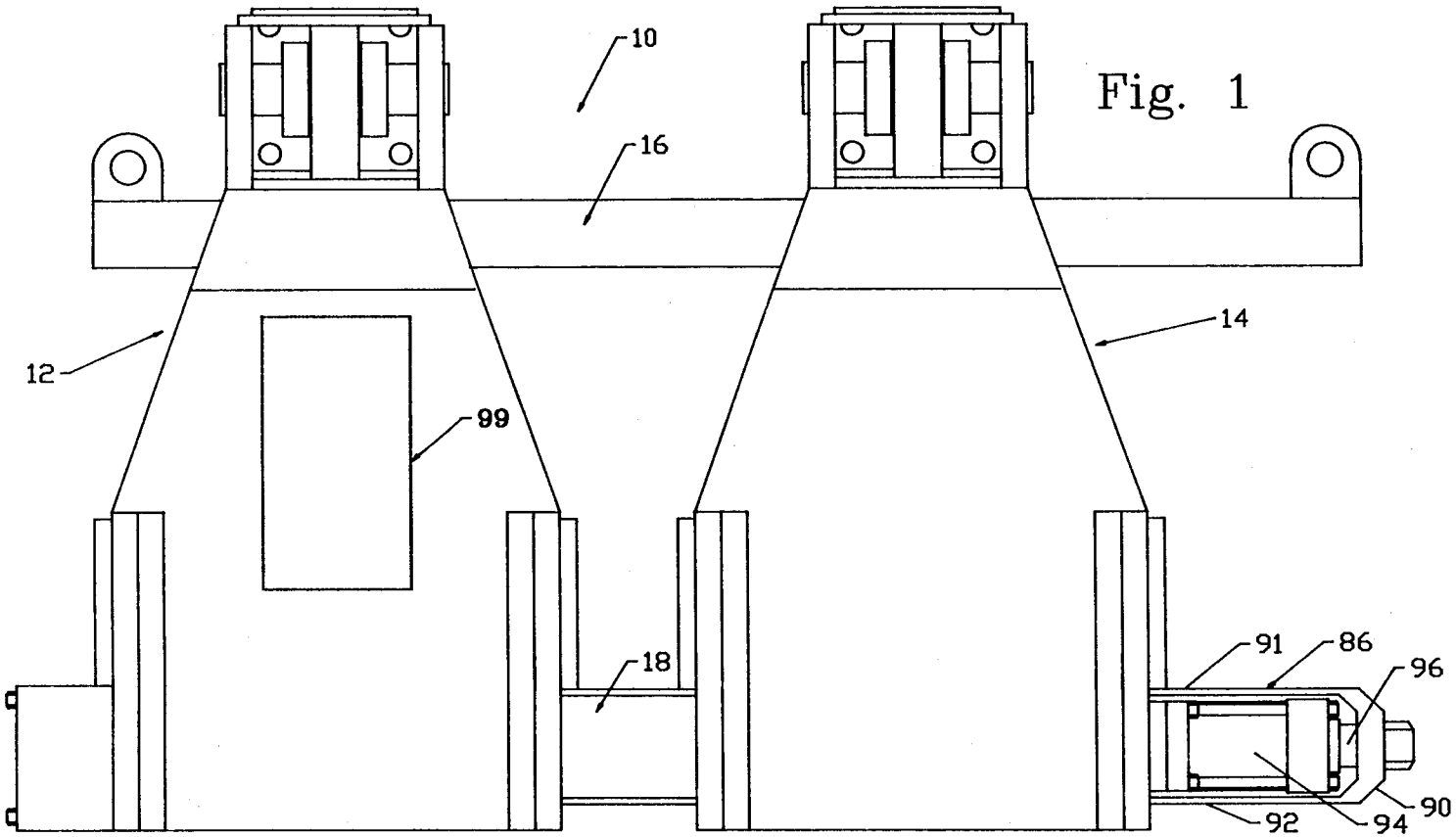
FIG. 1 is a side plan view of the suspended rail welder.
Figure 2:
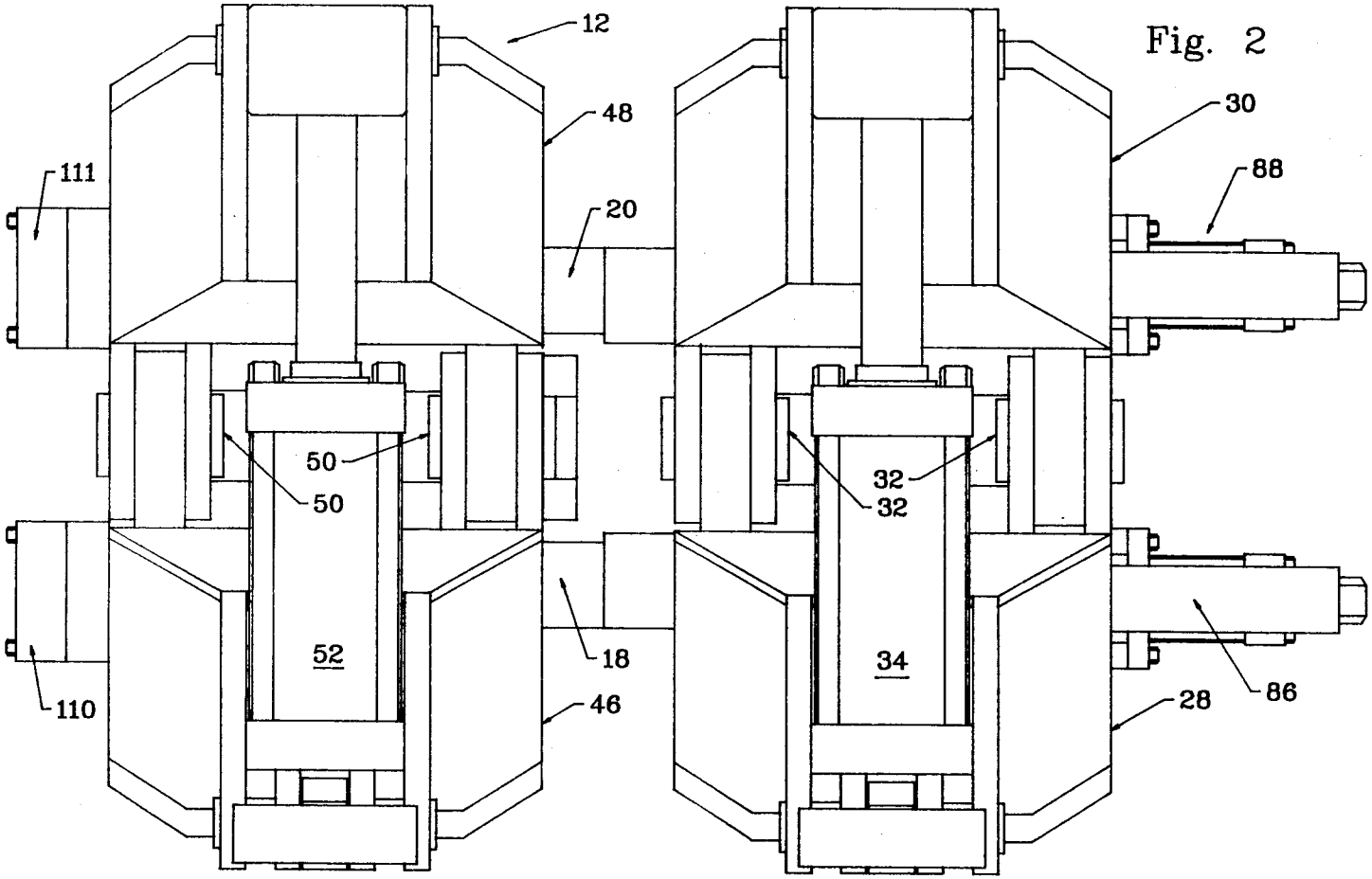
FIG. 2 is a top plan view of the suspended rail welder.

Referring now to the drawings, in FIGS. 1 and 2 it can be seen that the suspended rail welder 10 includes two clamping units 12 and 14, both of which are affixed to and carried by a beam 16. The beam 16 is attached to a boom or crane (not shown) for lifting and lowering the rail welder 10. The clamping units 12 and 14 are coupled to one another only by a pair of upset tube assemblies 18 and 20. These upset tube assemblies 18 and 20 each is formed of a hollow rectangular tube 22 which contains therein the respective ones of a pair of straight edges 24 and 26. These rectangular tubes 22 function as the upset rods for axially reciprocating the clamping units 12 and 14 with respect to one another during the welding operation, all as more specifically described below. These rectangular tubes 22 also support the straight edges 24 and 26 so that there are no bending forces exerted upon them, and shelter the straight edges 24 and 26 from mechanical damage and the process heat and dirt.

As will also be more apparent from the description below, the use of the hollow rectangular tubes 22 allows flat, tapered wedge bearings, which can be adjusted numerous times before replacement is required, as opposed to round bushings, which normally cannot be adjusted after the initial installation, to be used.

Figure 5:
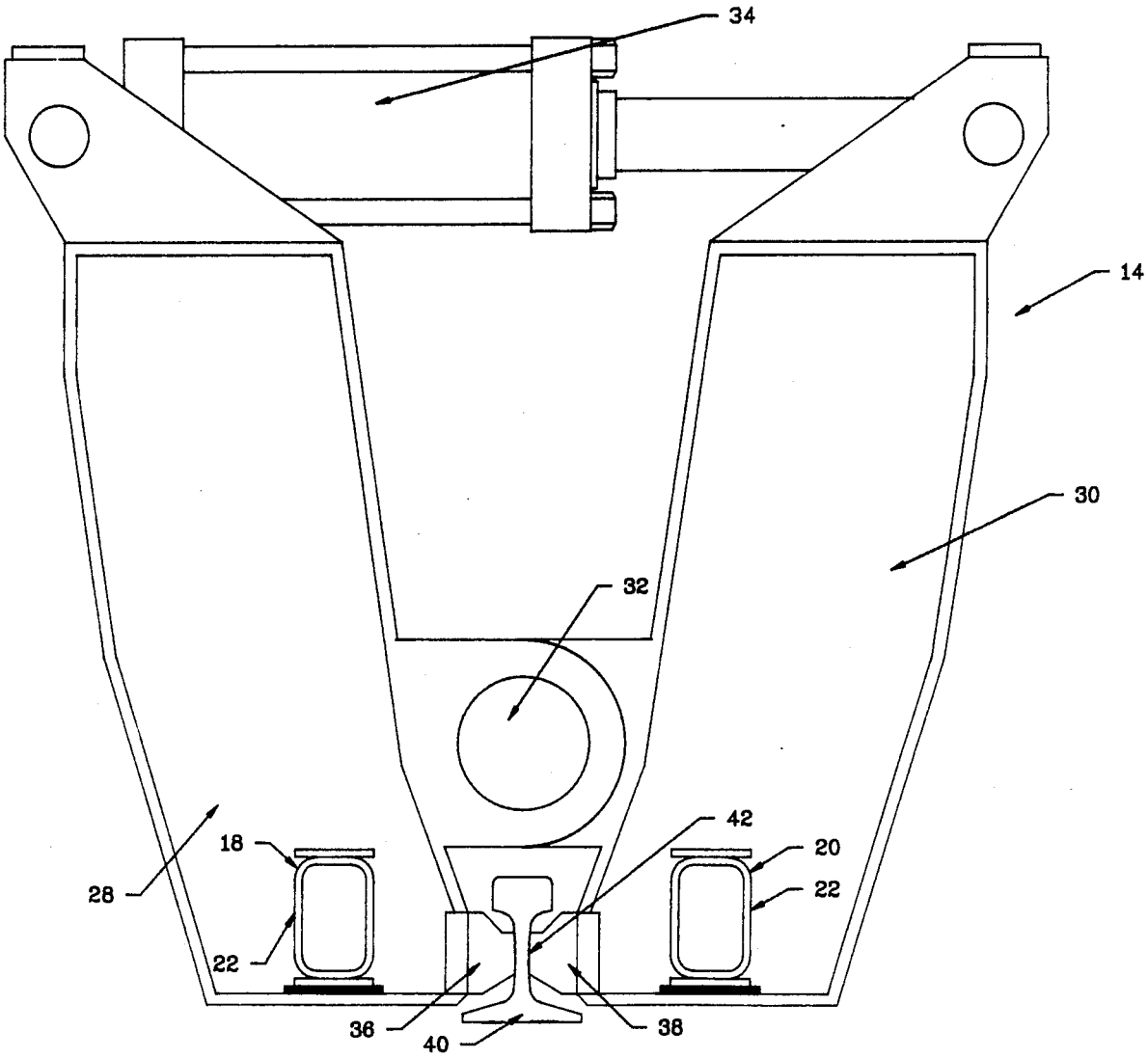
FIG. 5 is a partial side plan view, greatly simplified, of the other one of the clamping units of the suspended rail welder.

Generally, the clamping unit 14, as can be seen in FIG. 5, which is a greatly simplified view, is formed of two clamping arms 28, 30 which are rotatably and pivotally affixed to a pivot shaft 32. The upper ends of the clamping arms 28, 30 are coupled together by a hydraulic cylinder 34. The lower ends of the clamping arms 28, 30 include electrodes 36, 38 which are disposed to clamp the web portion 42 of a rail 40 when the clamping arms 28, 30 are pivotally rotated about the pivot shaft 32 by the hydraulic cylinder 34. Likewise, the clamping unit 12, as can be best seen in FIG. 3, which also is a greatly simplified view, is comprised of two clamping arms 46, 48 which are rotatably and pivotally affixed to a pivot shaft 50. The upper ends of these clamping arms 46, 48 are coupled together by a hydraulic cylinder 52, and their lower ends include electrodes 54 and 56 which also are disposed to clamp the web portion 60 of a rail 58 upon operation of the hydraulic cylinder 52.

Figure 3:
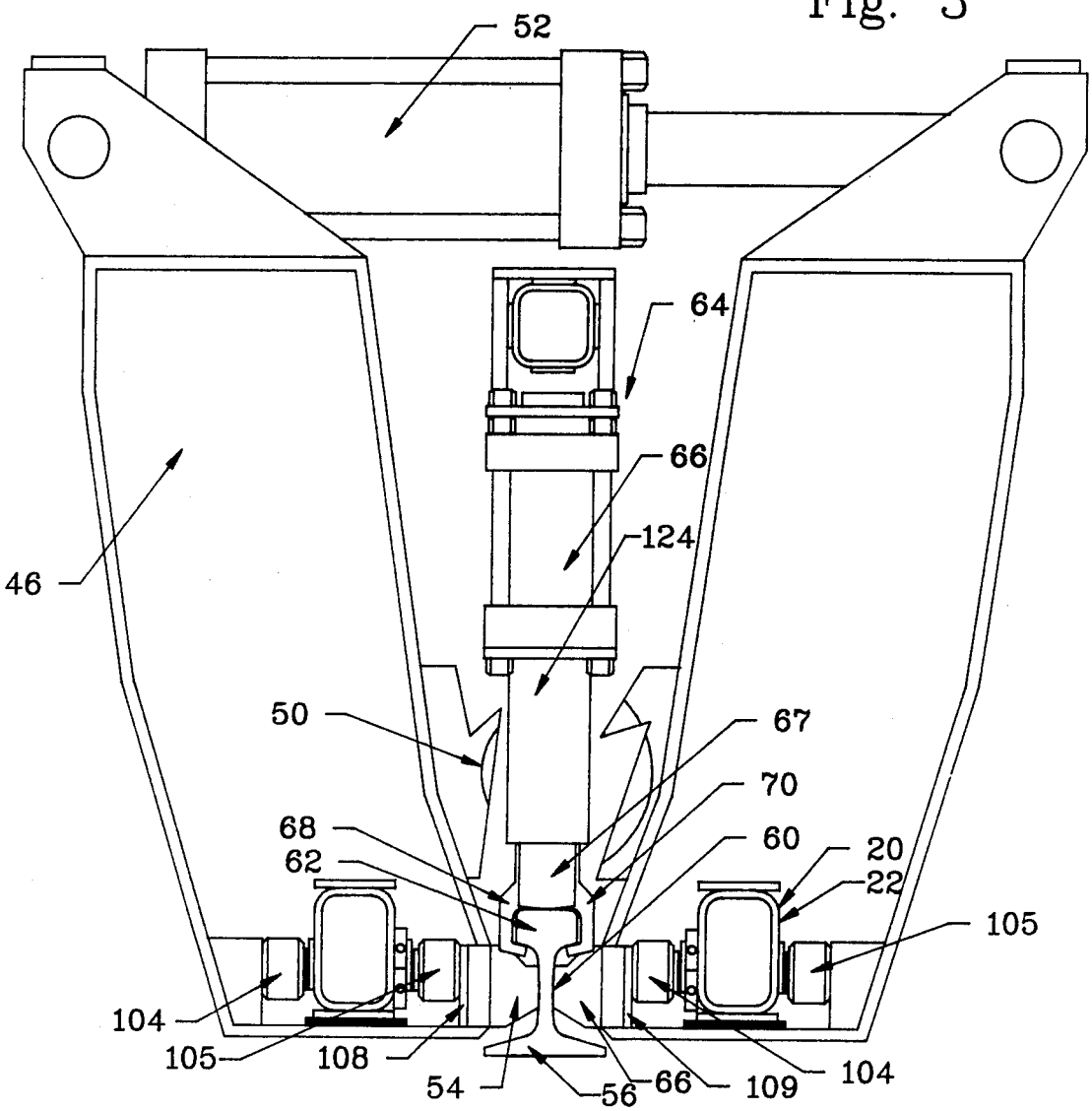
FIG. 3 is a partial side plan view, greatly simplified, of one of the clamping units of the suspended rail welder.

In addition, as can be seen in FIG. 3, between each of the respective pairs of the clamping arms 28, 30 and 46, 48 there is disposed a lift assembly 64 which includes a hydraulic cylinder 66 and a pair of clamping jaws 68, 70. These lift assemblies 64 are affixed to and vertically supported by the beam 16. The hydraulic cylinders 66 thereof are operable to open and close the clamping jaws 68, 70 to clamp a head of a rail, and to raise and lower the rail, all as more specifically described below.

The clamping arms 28, 30 and 46, 48 are formed of rigid steel structural members which enable a substantial clamping force to be applied to the rails. Steel plating is affixed about the clamping arms and form a housing for the various elements of the rail welder 10.

CLAMPING UNIT 14

The construction of the clamping unit 14 can be seen in FIGS. 1, 2, 5 and 6.

As indicated above, the upset tube assemblies 18 and 20 extend through both of the clamping units 12 and 14, and function as upset rods for axially displacing the clamping units 12 and 14 with respect to one another. Within the clamping unit 14, these upset tube assemblies 18 and 20 are clamped so that they are effectively rigidly secured therein. The upset tube assemblies 18 and 20 are clamped by means of flat, tapered wedge assemblies such as the wedge assemblies 72–74 and by friction plates such as the friction plates 76. Friction plates such as the friction plates 80–82 likewise are disposed between the respective ones of the wedge assemblies 72–74 and the upset tube assemblies 18–20. The upset tube assemblies 18 and 20 likewise are secured against vertical displacement by similar wedge assemblies and friction plates. The wedge assemblies 72–74 are adjustable by means of adjustment screws such as the adjustment screw 84 which is extended through one of the wedges forming the assembly and is threadedly received within a threaded bore in a structural portion of the clamping arms. In this fashion, the two wedges forming the wedge assemblies can be forced tightly together to tightly clamp against the upset tube assemblies and thereby clamp the upset tube assemblies 18–20 within the clamping unit 12. The friction plates are disposed between the wedge assemblies and the upset tube assemblies, and function as bearings to permit the clamping unit 14 to be axially and slidably displaced along the length of the upset tube assemblies 18 and 20, as more particularly described below.

Figures 6, 8:
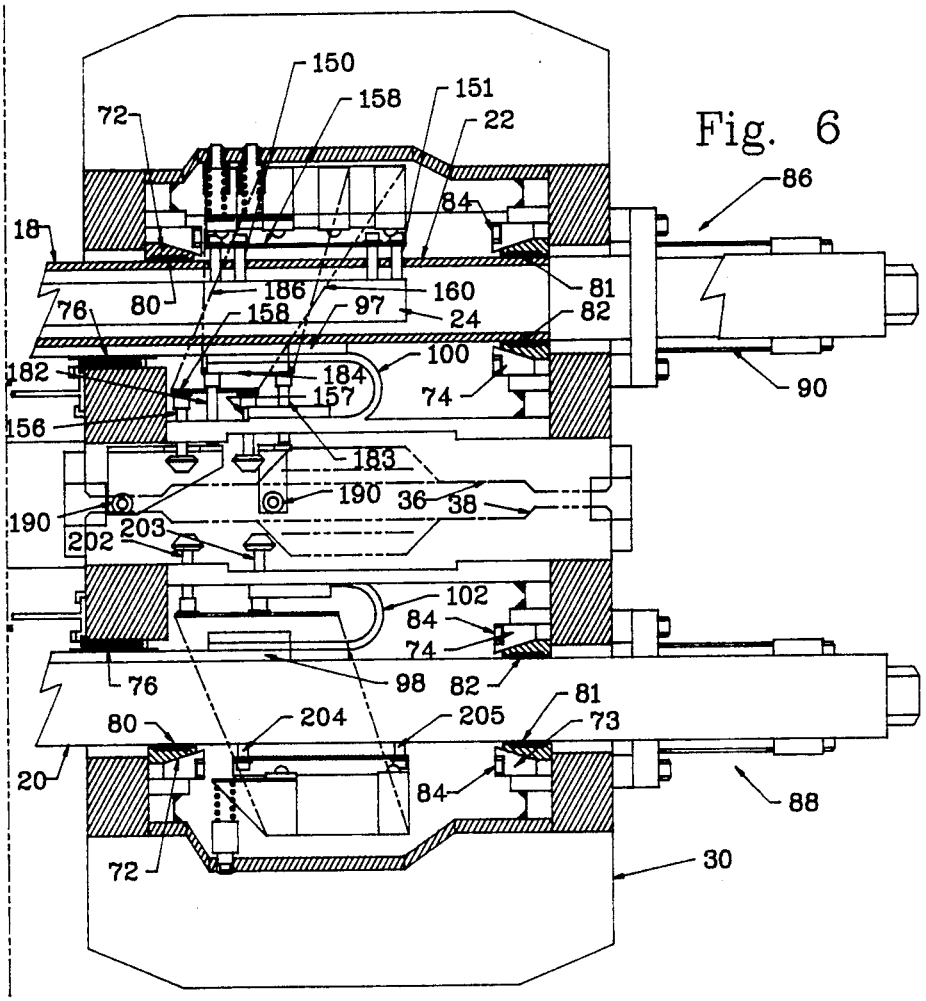
FIG. 6 is a bottom plan view, partially sectionalized, of one of the clamping units of the suspended rail welder.
FIG. 8 is a view illustrating how FIGS. 6 and 7 mate with one another.
Figure 7:
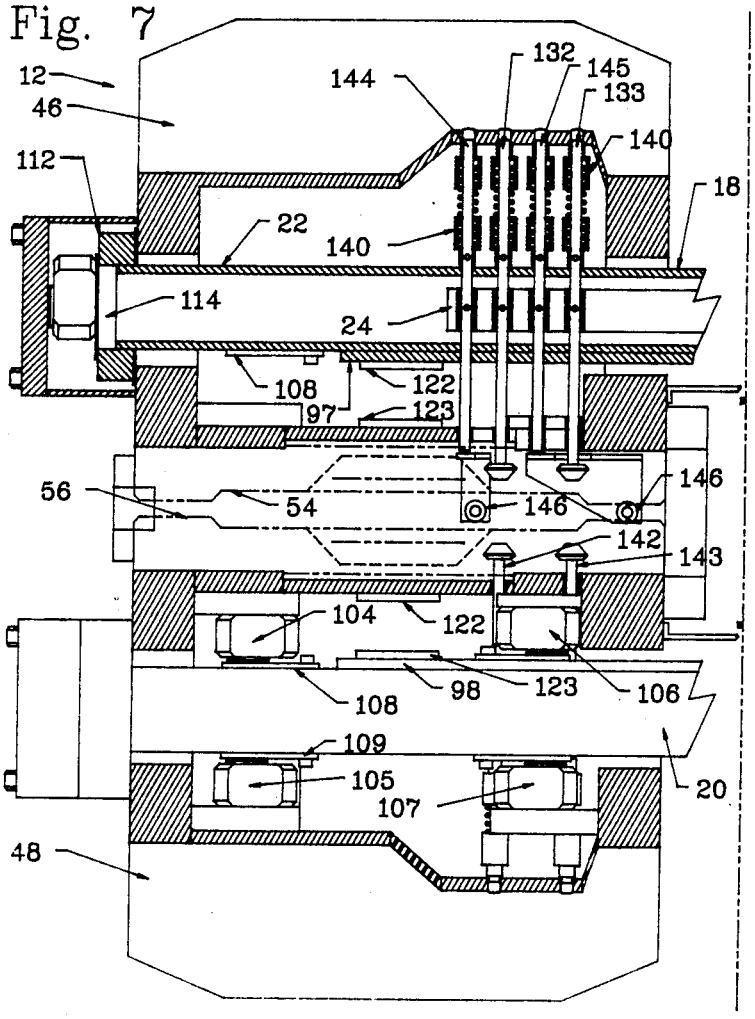
FIG. 7 is a bottom plan view, partially sectionalized, of the other one of the clamping units of the suspended rail welder.

An upset cylinder assembly 86 and 88 is affixed to the respective ones of the clamping arms 28 and 30, and each of these assemblies, as can be best seen in FIGS. 1 and 6, include a generally U-shaped member 90 having two arms 91 and 92 which extend through the clamping unit 14 and which are spaced apart to receive therebetween the respective upset tube assemblies 18 and 20. These arms 91 and 92 of the U-shaped members 90 are secured to the tops and bottoms of the upset tube assemblies 18 and 20. Hydraulic cylinders 94 also are disposed between the arms 91 and 92 of the U-shaped members 90, and the pistons 96 thereof are affixed to the U-shaped members 90. The arrangement is such that when the hydraulic cylinders 94 are operated, the clamping arms 28 and 30 and hence the clamping unit 14 can be axially and slidably reciprocally displaced with respect to the upset tube assemblies 18 and 20 which function as upset rods. The rail clamped within the clamping unit 14 also is axially reciprocally displaced with respect to the rail clamped in the clamping unit 12. With welding current applied to the electrodes 36, 38 and 54, 56, a welding current is produced in conventional fashion enabling the ends of the rails clamped within the two clamping units 12 and 14 to be butt-welded together.

Welding current is coupled to the electrodes 36 and 38 of the clamping arms 28 and 30 of the clamping unit 14 via bus bars 97 and 98 affixed to the sides of the respective ones of the upset tube assemblies 18 and 20, and via flexible bus bars 100 and 102 which are coupled to the electrodes. The bus bars 96 and 98 are electrically coupled with the transformers for producing the welding current which are contained within the housing of the clamping unit 12.

CLAMPING UNIT 12

The construction of the clamping unit 12 can be seen in FIGS. 1, 2, 3 and 7.

As indicated above the upset tube assemblies 18 and 20 extend out of the clamping unit 14 in which they are securely clamped into and through the clamping unit 12. The upset tube assemblies 18 and 20, however, are not clamped in the clamping unit 12 as they are in the clamping unit 14. Instead, as can be best seen in FIG. 7, there are two pairs of hydraulic cylinders 104, 105 and 106, 107 which are secured in spaced-apart relationship to the clamping arms 46 and 48 and which are disposed to engage the opposite sides of the respective ones of the upset tube assemblies 18 and 20 (in FIG. 7 only those hydraulic cylinders associated with the upset tube assembly 20 are shown for the sake of clarity). These hydraulic cylinders 104-107 all normally bear against pressure plates such as the pressure plates 108, 109 affixed to the sides of the upset tube assemblies 18 and 20. These hydraulic cylinders 104–107 function to horizontally align the rail clamped within the clamping unit 12, as more specifically described below.

An upset tube anchor assembly 110, 111 is affixed to each of the clamping arms 46, 48 and to the respective ones of the upset tube assemblies 18 and 20. These upset tube anchor assemblies 110, 111 each include collars 112 which are secured about a portion of the end of the upset tube assembly 18 and 20. End plates 114 are disposed within the collars 112 and are affixed to the ends of the upset tube assemblies 18 and 20. Housings 116 are affixed by means of bolts 117 to structural members of the clamping arms 46, 48 and are disposed about and conduct the forces of hydraulic cylinder 118 to the ends of the upset tube assemblies and the collars 112 and plates 114 affixed to them. The hydraulic cylinders 118 are affixed between the end plates 114 and end walls 120 of the housings 116. After the clamping arms 46, 48 are adjusted to horizontally align the rail clamped within the clamping unit 12, the hydraulic cylinders 118 are operated and with the housings 116 being bolted to the clamping arms 46, 48 the collars 112 are pressed against the clamping arms 46, 48 to effectively lock the clamping arms 46, 48 and the upset tube assemblies 18 and 20 in fixed positions with respect to one another.

As indicated above, the welding current to the electrodes 54, 56 of the clamping jaws 46, 48 is coupled to them via bus bars 96, 98 affixed to the upset tube assemblies 18, 20 and via bus straps 122, 123 coupled to the bus bars 96, 98 and the electrodes 54, 56.

LIFT ASSEMBLIES

Figure 10:
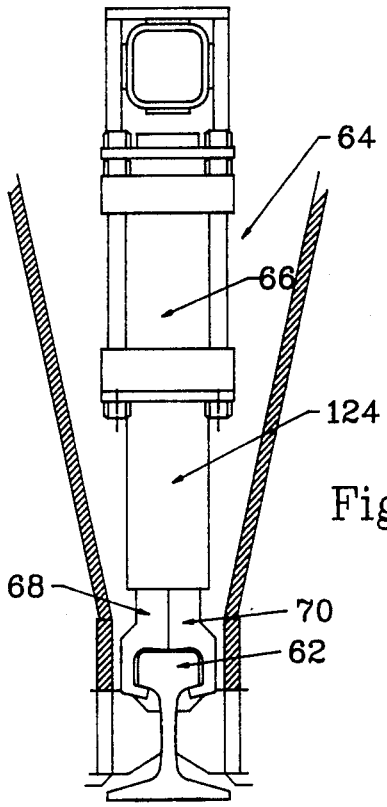
FIGS. 9 and 10 are partial side views, partially sectionalized, of one of the clamping units illustrating the lifting assembly included within each of the clamping units.
Figure 9:
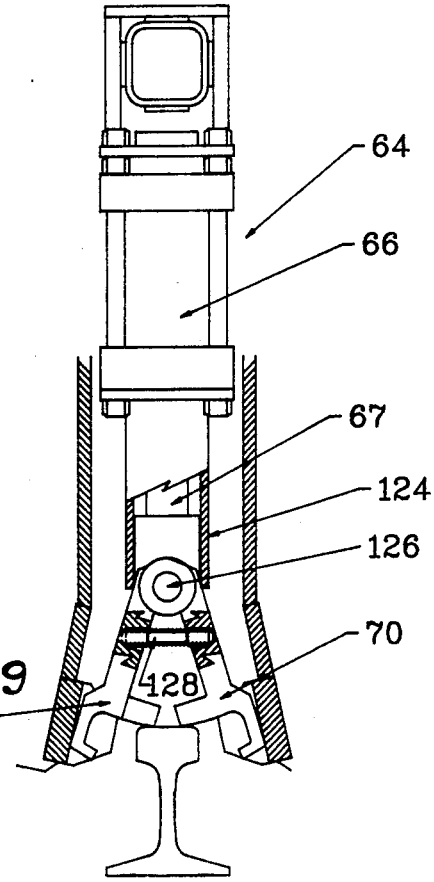

As indicated above, between each of the respective pairs of clamping arms 28, 30 and 46, 48, there is disposed a lift assembly 64, as disclosed in FIG. 3. Each of these lift assemblies 64, as can be best seen in FIGS. 3, 9 and 10, includes a hydraulic cylinder 66 having a piston 67 which extends through a hollow casing 124 secured to the hydraulic cylinder 66. Pivotally affixed to the end of the piston 67 by means of a pivot shaft 126 are the two clamping jaws 68, 70. The clamping jaws 68, 70 have affixed to them a compression spring assembly 128 which normally forces them to an open position. In operation, the clamping units 12, 14 are lowered until the clamping jaws 68, 70 which are extended out of the casing 124 to their open positions engage the top of the rail heads, as illustrated in FIG. 9. The hydraulic cylinder 66 is operated to draw its piston 67 upwardly into the casing 124, which action, in turn, forces the clamping jaws 68, 70 to close as they are drawn into the casing. As the clamping jaws 68, 70 close, the ends thereof clamp about the rail head of the rail, as illustrated in FIG. 10. The piston 67 is drawn into the casing 124 to an established position which may be a stop and, in this position, the rail has been lifted and positioned such that the electrodes 36, 38 and 54, 56 can clamp between them the web portion of the rail when the clamping arms 30, 32 and 46, 48 are closed.

STRAIGHT EDGES AND ALIGNMENT SYSTEM

Figure 15:
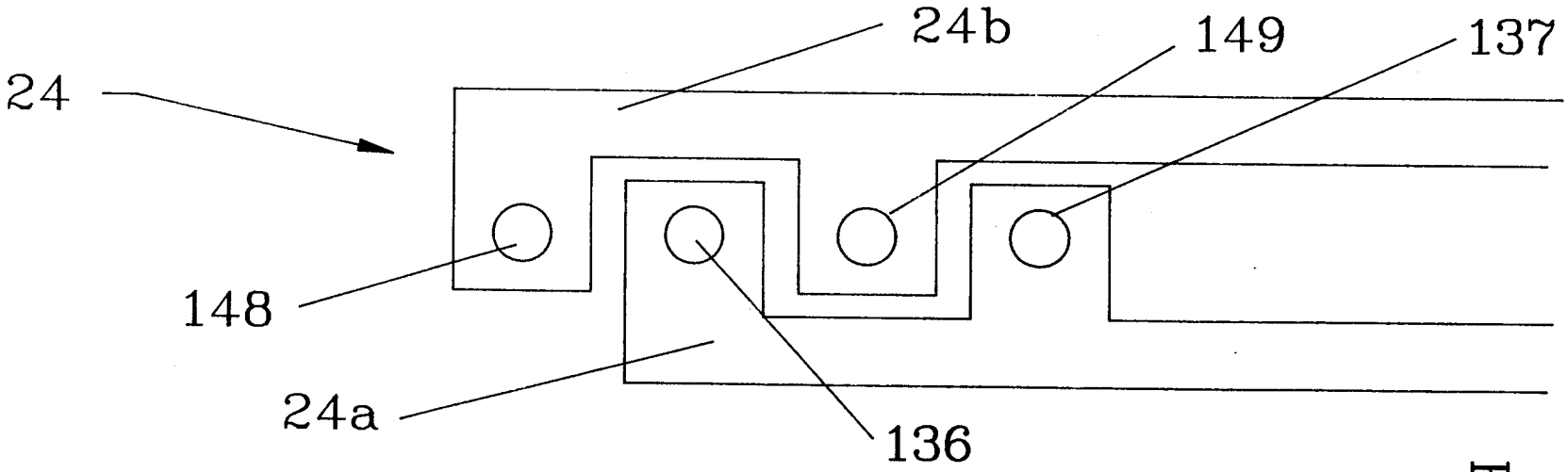
FIG. 15 is an enlarged sectional view of the straight edge taken along lines 15—15 of FIG. 7.

Each of the upset tube assemblies 18 and 20 contain therein a straight edge 24, 26, respectively, which extends between the two clamping units 12 and 14. The straight edge 24, as can be best seen in FIG. 15, is of a two-piece construction, with one piece **24*a* associated with the horizontal alignment of a rail, and the other piece 24*b* associated with the vertical alignment of a rail, as more specifically described below. The straight edges 24, 26 are supported by brackets 130, and while fixed against axial movement therein are free to move laterally. A pair of non-metallic push rods 132, 133 which have one end thereof affixed to and supported by the housing enclosing the clamping arm 46 extend horizontally through enlarged holes such as the enlarged holes 134, 135 in the upset tube assembly 18, bores 136, 137, respectively, in the straight edge 24*a* (FIG. 15), enlarged holes 138 in the housing, and abut against the rail head 62 of a rail clamped between the electrodes 54, 56 of the clamping unit 12. These push rods 132, 133 are spring loaded by means of compression spring assemblies such as the compression spring assembly 140 so as to press against the rail head. These push rods 132, 133 also are adjustably affixed to the straight edge 24a. The clamping arm 48 of the clamping unit 12 also contains similar non-metallic push rods 142, 143 which are adjustably affixed to the straight edge 26 and which abut against the rail head 62**.

The clamping arm 46 also has two additional push rods 144, 145 (FIGS. 7 and 13) which are supported in a similar fashion and extend through the upset tube assembly 18, bores 148, 149 in the straight edge 24b, respectively, and the housing thereof. The free end of these push rods 144, 145, however, have a deflecting spring assembly 146 affixed to them which engage the top of the rail head 62 and convert vertical movement of the rail to horizontal movement of the push rods, 144, 145.

The clamping unit 14 contains therein two push rods 150, 151 which are affixed to the straight edge 24*a* in spaced-apart relationship and which extend out of the upset tube assembly 18 through enlarged holes 152 formed in the latter. These push rods 150, 151 are of the same length and the ends thereof are affixed to a vertically disposed reference plate 154. Accordingly, since the straight edge 24*a* is parallel to the rail clamped in the clamping unit 12, the reference plate 154 in the clamping unit 14 is likewise parallel to the rail clamped in the clamping unit 12.

There also are two push rods 156, 157 which are affixed in spaced-apart relationship to a vertically disposed plate 158 that is part of a table 160. These push rods 156, 157 extend through enlarged holes 162 in the housing and are disposed to abut against the rail head 164 of a rail clamped in the clamping unit 14. The table 160 is L-shaped and its other horizontally disposed leg 166 is slidably disposed and supported atop the upset tube assembly 18. The leg 166 has affixed beneath it in spaced-apart relationship two sensors 168, 169, such that the latter are engageable by the reference plate 154. An L-shaped bracket 170 is affixed beneath each of the respective sensors 168, 169, and a compression spring 172 which is retained within and supported by a spring mount 174 affixed to the housing abuts against and applies pressure to the vertical leg 176 of the L-shaped bracket 170. The compression springs 172 therefore push the push rods 156, 158 against the rail head 164.

A similar arrangement is provided for sensing the vertical position of a rail clamped in the clamping unit 14. As can be best seen in FIGS. 6 and 14, two other non-metallic push rods 191, 193 are affixed to the straight edge 24*b* and extend horizontally out through enlarged holes 178 in the upset tube assembly 18. A vertically disposed reference plate 180 is affixed to these two push rods 191, 193. Two other non-metallic push rods 182, 183 are affixed to a vertical plate 184 of an L-shaped table 186, and extend horizontally through enlarged holes 188 in the housing. A deflecting spring assembly 190 is affixed to the ends of these push rods 182, 183 and presses against the top of the rail head 164. The deflecting spring assembly 190 emulates the operation of a bell crank to translate the vertical movement of the rail into horizontal movement of the push rods 182, 183. The L-shaped table 186 has a horizontal leg 192 slidably disposed and supported atop the upset tube assembly 18. A pair of sensors 194, 195 are affixed beneath the leg 192 so as to be engageable by the reference plate 180. Compression spring 196 retained within and supported by spring mounts 198 affixed to the housing press against an L-shaped bracket 200 affixed beneath the sensors 194, 195 which action, in turn, presses the push rods 182, 183 against the rail head 164.

In the clamping arm 30 of the clamping unit 14, there are two additional push rods 202, 203 which are disposed to engage the rail head 164, and two push rods 204, 205 which are affixed to the straight edge 26*b* within the upset tube assembly 20. The construction and operation of these push rods 202–205 are as described above with respect to the push rods in the clamping arm 28.

OPERATION OF THE RAIL WELDER

Now that the construction of the suspended rail welder 10 has been described, its operation in welding railroad rails together end-to-end to form a continuous railroad rail can be described as follows.

First of all, the railroad rails to be welded together end-to-end are aligned on the ties of the railroad track in an end-to-end relationship, in any suitable fashion. The rail welder 10 is lowered by a boom (not shown) until the clamping jaws 68, 70 of the lift assemblies 64 in the respective ones of the clamping units 12 and 14 engage the rail heads of the two rails to be welded together. Of course, the lift assembly 64 in the clamping unit 12 should engage with the rail head of one of the two rails, and the lift assembly 64 in the clamping unit 14 should engage with the rail head of the other one of the two rails.

The hydraulic cylinders 66 of the lift assemblies 64 are operated to retract their pistons 67 which action, in turn, draws the clamping jaws 68, 70 into the hollow casings 124. Upon being drawn into the hollow casings 124, the clamping jaws 68, 70 are forced to close and in doing so, clamp between them the rail heads of the rails. The pistons 67 are retracted until the rails are positioned to be clamped by the clamping arms 28, 30 and 46, 48 of the respective clamping units 12 and 14. At this time, the rails are raised approximately three inches off of the ties.

The clamping arms 28, 30 and 46, 48 are operated to clamp the respective ones of the two rails by operating the hydraulic cylinders 34 and 52 associated with them. The clamping arms 28, 30 pivotally close about the pivot shaft 32 to clamp the web portion 42 of the rail 40 between its electrodes 36, 38, as illustrated in FIG. 5, while the clamping arms 46, 48 simultaneously pivotally close about the pivot shaft 50 to clamp the web portion 60 of the rail 58 between its electrodes 54, 56, as illustrated in FIG. 3.

Figures 11, 12:
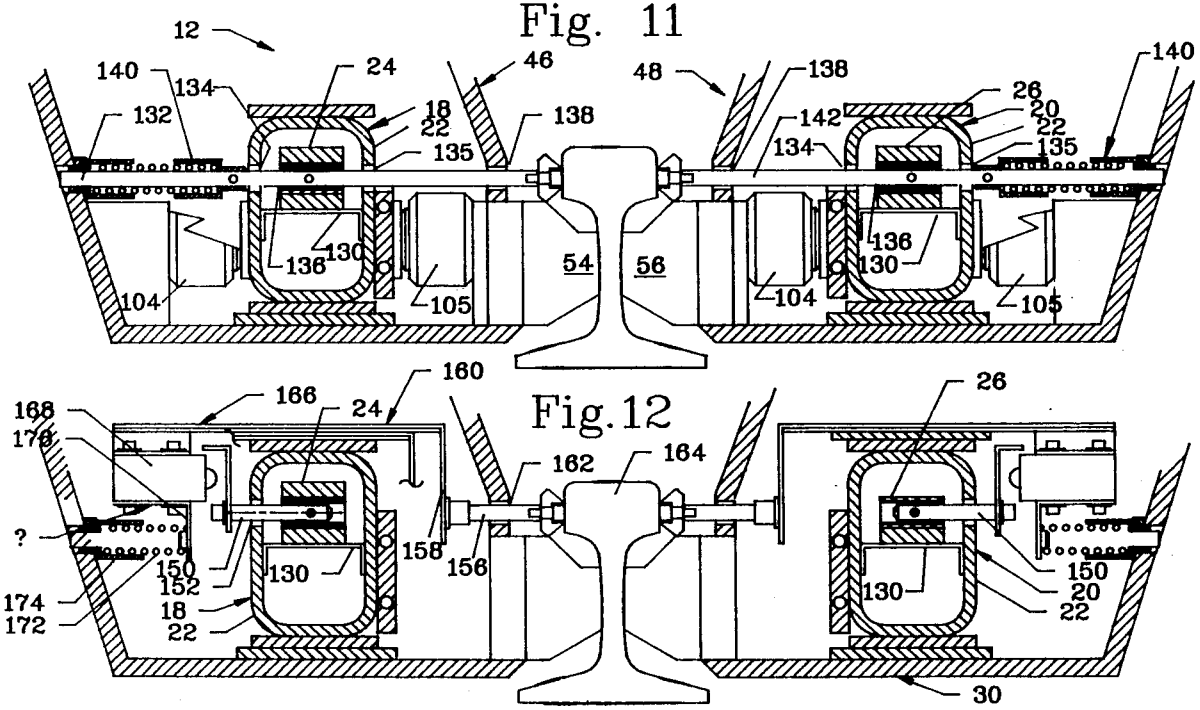
FIG. 11 is a partial, sectionalized side plan view of one of the clamping units illustrating the horizontal sensing and alignment system therein.
FIG. 12 is a view like FIG. 11 illustrating the horizontal sensing and alignment system in the other one of the clamping units.
Figure 14:
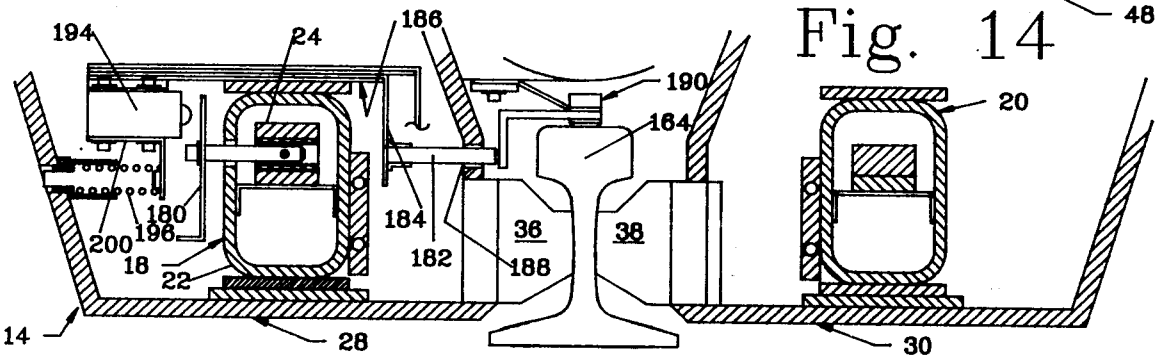
FIG. 14 is a view like FIG. 13 illustrating the vertical sensing and alignment system in the other one of the clamping units.

Looking first at the clamping unit 14, as indicated above, the upset tube assemblies 18 and 20 are securely clamped within this clamping unit, by means of wedge assemblies such as the wedge assemblies 72–74 and by means of friction plates such as the friction plates 76. When the clamping arms 28, 30 clamp the rail therein, the push rods 156, 157 engage the sides of the rail head and the push rods 182, 183 engage the top of the rail head, as illustrated in FIGS. 3 and 12 and FIGS. 3 and 14, respectively. As can be best seen in FIG. 12, when the push rods 156, 157 engage the side of the rail head, the table 160 and hence the sensors 168, 169 are slidably horizontally displaced depending upon the position of the rail clamped between the clamping arms 28, 30. The same is true with respect to the sensors 194, 195, depending upon the vertical position of the rail clamped between the clamping arms 28, 30.

Figure 13:
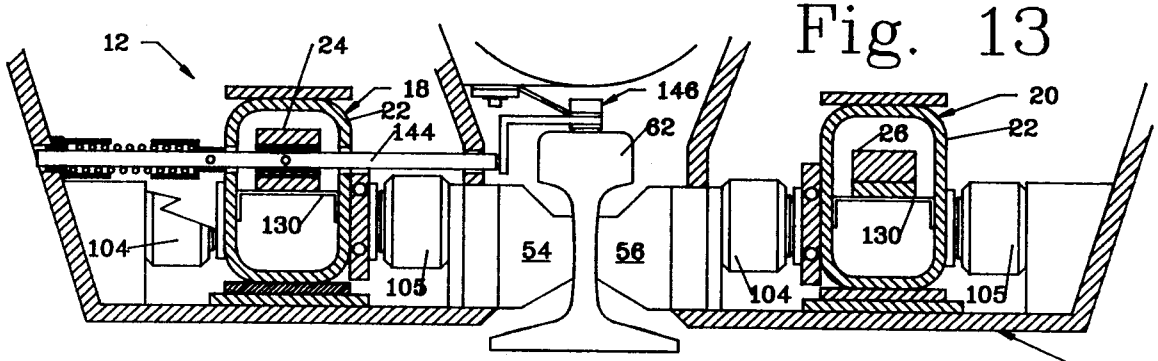
FIG. 13 is a partial, sectionalized side plan view of one of the clamping units illutrating the vertical sensing and alignment system therein.

In the clamping unit 12, the push rods 132, 133 likewise engage against the sides of the rail head, as can be best seen in FIGS. 3 and 11, and the push rods 145, 146 engage against the top of the rail head, as can be best seen in FIGS. 3 and 13. Assuming that the end of the rail clamped in the clamping unit 12 is not horizontally or vertically aligned with the end of the rail clamped in the clamping unit 12, the sensors 168, 169 and 194, 195 detect the mis-alignment and couple signals to indicator dials or lights (not shown) which can be observed by the operator. The sensors 168, 169 in the respective ones of the clamping arms 28, 30 permit the operator to select the system and rail head side to be aligned, such that the rail head sides against which the flange of the wheels of the railroad cars will engage can be aligned. Similar signalization may be used to activate a programmed controller to automatically diminish or eliminate the error by activation of selected ones of the hydraulic cylinders.

Both angular horizontal and angular vertical errors are encountered in practice. These are corrected by similar actuation of the several horizontal cylinders to individually solve the nearest and most remote error conditions, as the more obvious simple horizontal offset is corrected above. The vertical angular error is corrected by the selective actuation of the two-crane (not shown) lifting cables to raise and lower the individual ends of the welder with light clamping force present. This changes the angular relation of the two rail tops until the sensed error is reduced to acceptable limits. These corrections generate vertical offset errors, which are eliminated to acceptable limits by the activation of the rail life assemblies. When vertical errors are with tolerances, the clamping units are applied forcefully to entrap the adjustments.

Figure 4:
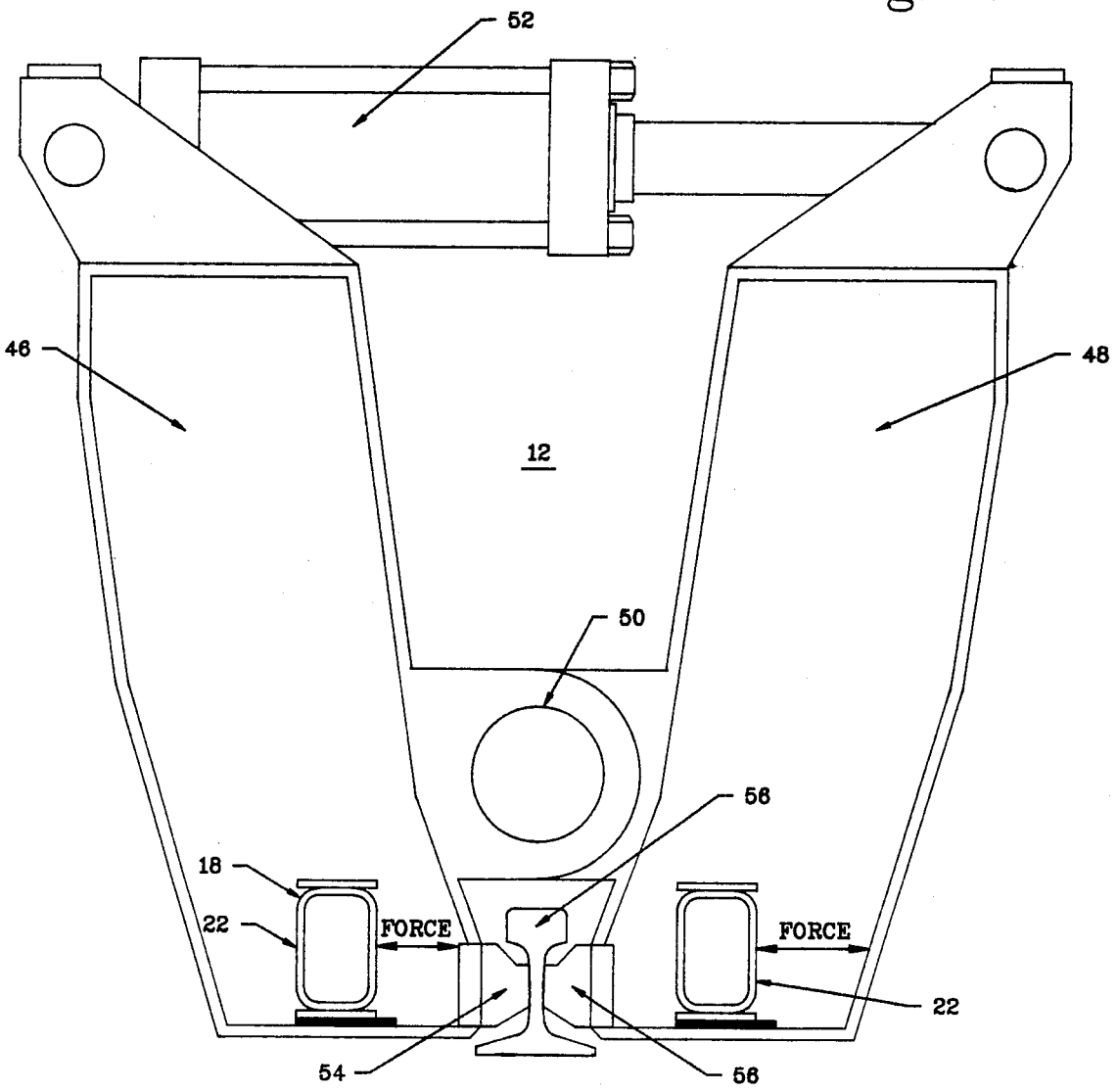
FIG. 4 is a partial side plan view like FIG. 3, illustrating the manner in which a force is applied to the clamping unit to horizontally position a rail.

To horizontally align the end of the rail clamped in the clamping unit 12 with the rail clamped in the clamping unit 14, the respective ones of the hydraulic cylinders 104–107 are operated and, as can be best seen in FIG. 4, these hydraulic cylinders 104–107 exert a force between the upset tube assemblies 18 and 20 which are effectively clamped against movement by being clamped in the clamping unit 14 and the electrode 50, or 52, and the clamping arm 46, or 48, to horizontally move the rail to the right or left. As the rail is horizontally moved, the push rods 132, 133 or 142, 143 are likewise moved. The movement of the push rods 132, 133, or 142, 143, in turn, move the straight edge 24*a*, or 26.

As indicated above, the reference plates 154 in the clamping unit 14 are parallel with the rail clamped in the clamping unit 12, and when the latter is horizontally moved, the straight edge 24*a* or 26 likewise is horizontally moved and in so moving horizontally moves the reference plates 154 toward or away from the sensors 168, 169. These sensors 168, 169 detect the position of the reference plates 154 and hence the end of the rail clamped in the clamping unit 12 and, when the ends of the rails clamped in the claping units 12, 14 are horizontally aligned, the sensors 168, 169 couple signals to the indicators or lamps to so advise the operator.

The operation is essentially the same if the end of the rail clamped in the clamping unit 12 is not vertically aligned with the end of the rail clamped in the clamping unit 14. In this case, however, the vertical mis-alignment of the ends of the rails is detected by the sensors 194, 195 in the clamping unit 12 and a signal is coupled to indicators or lamps observed by the operator. The rail is vertically raised or lowered by operating the hydraulic cylinder 66 of the lift assembly 64 associated with the clamping unit 12. When the rail is raised or lowered, this vertical movement is sensed by the deflecting spring assemblies 190 which emulate a bell crank and translate the vertical movement to horizontal movement of the push rods 182, 183 which, in turn, horizontally moves the straight edge 24*b*. Again, through the movement of the straight edge 24*b*, the reference plate 180 is moved toward or away from the sensors 194, 195 and when proper vertical alignment is detected, the sensors 194, 195 couple signals to the indicators or lamps observed by the operator to advise him of the alignment of the ends of the rails. The operator can horizontally and vertically manipulate the rail clamp in the clamping unit 12 in the above-described fashion until the ends of the rails clamped within the two clamping units 12, 14 are properly aligned.

When the ends of the rails are aligned, the upset tube anchor assemblies 110, 111 are operated to effectively clamp or lock the upset tube assemblies 18, 20 and the clamp arms 46, 48 in position with respect to one another, to thereby effectively lock the ends of the rails in position with respect to one another. This is accomplished by operating the hydraulic cylinders 118 contained within the housings 116 to clamp the collars 112 about the ends of the upset tube assemblies 18, 20 against the clamping arms 46, 48, respectively, as more specifically described above.

With the ends of the rails clamped in the respective ones of the clamping units 12, 14 aligned, and the upset tube assemblies 18, 20 now clamped in the clamping unit 12, welding current is applied to the electrodes 36, 38 and 54, 56. The clamping unit 14 now is upset with respect to the clamping unit 12 to butt weld the ends of the rails clamped therein together. The clamping unit 14 is upset with respect to the clamping unit 12 by horizontally reciprocating it along the length of the upset tube assemblies 18, 20, by operation of the hydraulic cylinders 94 in the upset cylinder assemblies 86, 88. When the ends of the rails are heated sufficiently to butt weld them together, the clamping unit 14 is horizontally displaced to butt the end of the rail clamped therein against the rail clamping unit 12 to form the weld.

The rails clamped in the clamping unit 14 are continuously welded to the rail clamped in the clamping unit 12 as described above to form a continuous rail.

HYDRAULIC SYSTEM AND ELECTRICAL SYSTEM

The hydraulic system for operating the various hydraulic cylinders of the suspending rail welder 10 and the electrical system thereof form no part of the present invention for such systems are generally well-known in the art and may be designed in any one of a number of different fashions. It is only necessary that these systems function to operate the rail welder 10 in the manner described above to clamp, align and weld together the rail ends to form a continuous rail.

What is claimed is:

1. A suspended rail welder for welding railroad rails together end-to-end to form a continuous rail comprising:

a first and a second clamping unit carried by a beam which is adapted to be raised and lowered by a boom or the like to vertically position said first and second clamping units with respect to the rails to be welded together, said first and second clamping units each comprising a pair of clamping arms which are pivotally and rotatably operable to clamp therebetween the web portion of a rail;

a first upset tube assembly extending between and disposed within one of said pair of clamping arms of each of said first and second clamping units;

a second upset tube assembly extending between and disposed within the other one of said pair of clamping arms of said first and second clamping units;

said first and second upset tube assemblies each comprising a hollow rectangular tube, said hollow rectangular tubes of said first and second upset tube assemblies being clamped against lateral and vertical movement within said second clamping unit and functioning as upset rods for axially reciprocating said second clamping unit with respect to said first clamping unit; and an upset cylinder assembly affixed to the respective ones of said pair of clamping arms of said second clamping unit and to said rectangular tube of said upset tube assembly disposed therein for axially reciprocating said second clamping unit on said rectangular tubes of said upset tube assemblies with respect to said first clamping unit.

2. The suspended rail welder of claim 1, wherein said hollow rectangular tubes of said first and second upset tube assemblies are clamped against lateral and vertical movement in said second clamping unit by means of wedge assemblies, said wedge assemblies being adjustable for wear, whereby said hollow tubes can be retained tightly clamped therein.

3. The suspended rail welder of claim 2, further comprising between said wedge assemblies and said hollow rectangular tubes flat surface bearings which are non-metallic, said non-metallic flat surface bearing further providing electric insulation between adjacent electrically charged parts.

4. The suspended rail welder of claim 1, wherein said pair of clamping arms of said first clamping unit normally are freely moveable with respect to said first and second upset tube assemblies, an anchor assembly affixed to the respective ones of said pair of clamping arms of said first clamping unit and to the one of said first and second upset tube assemblies therein, said anchor assemblies each including therein a hydraulic cylinder which is operable to lockingly clamp the respective ones of said clamping arms and its associated one of said first and second upset tube assemblies in fixed relationship with one another whereby transaxial and axial movement is eliminated.

5. The suspended rail welder of claim 1, wherein said pair of clamping arms of each of said first and second clamping units is pivotally affixed together by a pivot shaft, an electrode at one end of each of said pair of clamping arms, and a hydraulic cylinder coupled between said pair of clamping arms at the other end thereof for pivotally rotatably operating said pair of clamp arms to clamp the web portion of a rail between said electrodes.

6. The suspended rail welder of claim 1, wherein each of said first and second clamping units comprises a lift assembly disposed between said pair of clamping arms thereof and supported by said beam, said lift assemblies each comprising a hydraulic cylinder having a piston, a hollow casing disposed about said piston and affixed at one end thereof to said hydraulic cylinder, a pair of clamping jaws for clamping therebetween the head of a rail pivotally affixed to said piston, said pair of clamping jaws being operable to clamp therebetween the head of a rail when said hydraulic cylinder is operated to retract said piston and said pair of clamping jaws into said hollow casing, the rail being vertically lifted as said piston and said pair of clamping jaws are further drawn into said hollow casing.

7. The suspended rail welder of claim 1, further comprising a straight edge within at least one of said rectangular tubes of said first and second upset tube assemblies, said straight edge extending between and into each of said first and second clamping units, sensor means in said second clamping unit which is adjustably positioned by the rail clamped therein in accordance with the horizontal position thereof, a reference plate associated with said sensor means affixed to said straight edge and parallel therewith in said second clamping unit, a plurality of push rods in said first clamping unit affixed to said straight edge and adapted to engage the side of the head of a rail clamped therein, said plurality of push rods upon engaging the side of the rail clamped in said first clamping unit laterally positioning said straight edge within said rectangular tube to thereby laterally position said reference plate in said second clamping unit with respect to said sensor means, said sensor means detecting the position of said reference plate and hence the position of the rail clamped in said first clamping unit with respect to the rail clamped in said second clamping unit; means within said first clamping unit for horizontally adjusting the position of the rail clamped therein, said straight edge being laterally moved by said plurality of push rods as the position of said rail is horizontally adjusted and laterally positioning said reference plate with respect to said sensor means, said sensor means providing a signal when the rail in said first clamping unit is horizontally aligned with the rail clamped in said second clamping unit.

8. The suspended rail welder of claim 7, further comprising a second straight edge within the other one of said rectangular tubes of said first and second upset tube assemblies, said second straight edge extending between and into each of said first and second clamping units, second sensor means in said second clamping unit which is adjustably positioned by the rail clamped therein in accordance with the horizontal position thereof, a second reference plate associated with said second sensor means affixed to said second straight edge and parallel therewith in said second clamping unit, a plurality of second push rods in said first clamping unit affixed to said second straight edge and adapted to engage the other side of the head of a rail clamped therein, said plurality of second push rods upon engaging the other side of the rail clamped in said first clamping unit laterally positioning said second straight edge within said other rectangular tube to thereby laterally position said second reference plate in said second clamping unit with respect to said second sensor means, said second sensor means detecting the position of said second reference plate and hence the position of the rail clamped in said first clamping unit with respect to the rail clamped in said second clamping unit; said second straight edge being laterally moved by said plurality of second push rods as the position of said rail is horizontally adjusted and laterally positioning said second reference plate with respect to said second sensor means, said second sensor means providing a signal when the rail in said first clamping unit is horizontally aligned with the rail clamped in said second clamping unit, whereby an operator can horizontally align the ends of the rails to be welded together end-to-end depending upon the side of the head of the rail which is to be engaged by the flange of the wheels of a railroad car.

9. The suspended rail welder of claim 8, further comprising another straight edge within at least one of said rectangular tubes of said first and second upset tube assemblies, said other straight edge extending between and into each of said first and second clamping units, third sensor means in said second clamping unit which is adjustably positioned by the rail clamped therein in accordance with the vertical position thereof, a third reference plate associated with said third sensor means affixed to said other straight edge and parallel therewith in said second clamping unit, a plurality of push rods in said first clamping unit affixed to said other straight edge and adapted to engage the top of the head of a rail clamped therein, said plurality of push rods upon engaging the top of the rail clamped in said first clamping unit laterally positioning said other straight edge within said rectangular tube to thereby laterally position said third reference plate in said second clamping unit with respect to said third sensor means, said third sensor means detecting the position of said third reference plate and hence the position of the rail clamped in said first clamping unit with respect to the rail clamped in said second clamping unit; means within said first clamping unit for vertically adjusting the position of the rail clamped therein, said other straight edge being laterally moved by said plurality of third push rods as the position of said rail is vertically adjusted and laterally positioning said third reference plate with respect to said third sensor means, said third sensor means providing a signal when the rail in said first clamping unit is vertically aligned with the rail clamped in said second clamping unit.

10. The suspended rail welder of claim 7, further comprising another straight edge within at least one of said rectangular tubes of said first and second upset tube assemblies, said other straight edge extending between and into each of said first and second clamping units, sensor means in said second clamping unit which is adjustably positioned by the rail clamped therein in accordance with the vertical position thereof, a reference plate associated with said sensor means affixed to said other straight edge and parallel therewith in said second clamping unit, a plurality of push rods in said first clamping unit affixed to said other straight edge and adapted to engage the top of the head of a rail clamped therein, said plurality of push rods upon engaging the top of the rail clamped in said first clamping unit laterally positioning said other straight edge within said rectangular tube to thereby laterally position said reference plate in said second clamping unit with respect to said sensor means, said sensor means detecting the position of said reference plate and hence the position of the rail clamped in said first clamping unit with respect to the rail clamped in said second clamping unit; means within said first clamping unit for vertically adjusting the position of the rail clamped therein, said other straight edge being laterally moved by said plurality of push rods as the position of said rail is vertically adjusted and laterally positioning said reference plate with respect to said sensor means, said sensor means providing a signal when the rail in said first clamping unit is vertically aligned with the rail clamped in said second clamping unit.

* * * * *